United States Patent [19]

Nelson

[11] Patent Number: 4,906,352

[45] Date of Patent: Mar. 6, 1990

[54] IMPROVED TENSIONING ASSEMBLY FOR VIBRATORY SCREENS

[75] Inventor: Richard L. Nelson, Princeton, Ill.

[73] Assignee: Production Engineered Products, Inc., Walnut, Ill.

[21] Appl. No.: 368,162

[22] Filed: Jun. 14, 1989

Related U.S. Application Data

[63] Continuation of Ser. No. 85,873, Aug. 13, 1987, abandoned.

[51] Int. Cl.[4] ..... B07B 1/46; B07B 1/48

[52] U.S. Cl. ..... 209/403; 209/319; 209/405

[58] Field of Search ..... 209/309, 311, 313, 398, 209/399, 400, 401, 402, 403, 404, 405, 319, 409, 412; 160/378

[56] References Cited

U.S. PATENT DOCUMENTS

| | | | |
|---|---|---|---|
| 810,682 | 1/1906 | Shaffer et al. | 209/400 |
| 2,077,678 | 4/1937 | Delamater | 209/346 |
| 2,334,707 | 11/1943 | Johnson | 209/403 |
| 2,338,523 | 1/1944 | Lincoln | 209/403 |
| 2,804,208 | 8/1957 | Van Harde feld et al. | 209/403 |
| 2,864,500 | 12/1958 | Miller | 209/404 X |
| 2,985,303 | 5/1961 | Wright | 209/403 |
| 4,133,751 | 1/1979 | Stengel | 209/404 |
| 4,137,157 | 1/1979 | Deister et al. | 209/403 |
| 4,140,630 | 2/1979 | Scarlett et al. | 209/403 X |
| 4,444,656 | 4/1984 | Nelson et al. | 209/347 |
| 4,529,510 | 7/1985 | Johnson et al. | 209/403 |

FOREIGN PATENT DOCUMENTS

| | | | |
|---|---|---|---|
| 0238455 | 9/1987 | European Pat. Off. | 209/403 |
| 1017072 | 12/1982 | France . | |
| 0971513 | 11/1982 | U.S.S.R. | 209/404 |

*Primary Examiner*—Donald T. Hajec

*Attorney, Agent, or Firm*—Lockwood, Alex, FitzGibbon & Cummings

[57] ABSTRACT

An improved tensioning assembly for vibratory screens includes a rigid frame, at least one classifying screen in the frame, an anchor for anchoring one end of the screen, and a rotatable tensioning assembly at the other end of the screen for both anchoring the other end of the screen and tensioning the screen by rotation of the rotatable assembly. The anchor at the one end of the screen includes a plurality of threaded adjustment members spaced along the length of the anchor for flexing the anchor to selectively and incrementally further adjust the tension on the screen to compensate for tension variations across the width of the screen due to torque differentials in the rotatable tensioning assembly.

21 Claims, 2 Drawing Sheets

IMPROVED TENSIONING ASSEMBLY FOR VIBRATORY SCREENS

This application is a continuation of application Ser. No. 085,873 filed Aug. 13, 1987, now abandoned.

BACKGROUND AND SUMMARY OF THE INVENTION

The present invention relates generally to vibratory material screening apparatus employed in the classifying of solid particulate matter and, more particularly, to such screening apparatus which employs a rotatable tensioning assembly for tensioning of the screen in such apparatus.

Vibratory screening decks have been widely employed in the past for the classification and separation of particulate solids of varying particle sizes and compositions, such as limestone, coal and other ores. Such screening decks have typically comprised a generally rectangular frame which is suspended in operation and which has one or more screens in the frame upon which the materials to be classified are deposited. The frame and screening deck are suspended at an angle, and either the entire frame with the screen or the individual screens are vibrated to cause the solid particulates to move down the screen deck. As the materials move down the vibrating screen or screens, solids of smaller mesh size pass through the screen as "unders", and solids of larger dimensions are discharged from the lower end of the screen as "overs."

One form of such screening deck is disclosed in U.S. Letters Pat. No. 4,732,670. In the screening deck disclosed therein one or more wire cloth screens having a predetermined mesh size to permit the passage therethrough of material are anchored at opposite ends of the screens to members extending transverse to the frame walls. In such screening deck one end of the screen is stationarily anchored over its width, and the other end of the screen is anchored to a rotatable tensioning assembly which, when rotated, adjusts the tension across the width of the screen.

Although the aforementioned rotatable tensioning assembly produces a screen tension across its width which is sufficently uniform to be satisfactory in many installations and uses, the degree of uniformity of the tension may not be entirely satisfactory in some installations, depending upon the width of the screening deck, the screen wire diameter and spacing and the needs of the user. This is because some degree of differential in tension across the width dimension of the screen in these latter installations may arise due to a differential in torque which may occur over the length of the rotatable tensioning tube when a tension is taken on the screen by the rotatable tensioning assembly. For example, where the rotatable tube of the rotatable tensioning assembly is rotated at each of its ends, the anchoring element on the surface of the tube may rotate over a greater distance adjacent its ends where the torque is applied to the tube than in the center of the tube because of the tensile characteristics of the elongate rotatable tube. As a result of this torque difference, a greater tension will tend to result in the screen at its outer edges than in the center. Due to this difference in screen tension across the width dimension of the screen, either one of two undesirable conditions may result.

One condition that might arise is that if the center of the screen is properly tensioned, the edges of the screen may be over-tensioned. Although the over-tensioning of the screen edges will actually improve the "whip" of the screen and have a beneficial result on production, such over-tensioning will result in fatigue in the screen wire adjacent its edges and unacceptable early wear of the screen adjacent its edges requiring early screen replacement.

The other condition that might arise is that if the edges of the screen are properly tensioned, the center of the screen may be under-tensioned. This does reduce the rate of wear of the screen, but results in decreased and inefficient production adjacent the center of the screen.

The improved tensioning assembly of the present invention overcomes the aforementioned shortcomings. In the improved tensioning assembly incorporating the principles of the present invention, the uniformity of screen tension adjustment in a rotatable tensioning assembly may be easily and accurately accomplished across the entire width dimension of the screen. Thus, excessive wear is substantially reduced and screen efficiency and production substantially improved.

In one principal aspect of the present invention, a classifying apparatus comprises a rigid frame and a classifying screen in the frame. Anchor means anchors one end of the screen, and first tensioning means for tensioning the screen includes at least one elongate rotatable means adjacent the other end of the screen which extends substantially across the width of the other end of the screen. The improvement in the apparatus comprises second tensioning means for selectively and incrementally adjusting the tension on the screen along the dimension over which the rotatable means extends.

In another principal aspect of the present invention, the second aforementioned tensioning means comprise the anchor means.

In still another principal aspect of the present invention, the second tensioning means comprise an elongate rigid beam which extends across the frame adjacent the one end of the screen, and the anchor means includes at least one screen anchor which also extends across the frame in spaced relationship to the beam. An adjustment means is provided for selectively and incrementally adjusting the space between the beam and the anchor along their respective lengths.

In still another principal aspect of the present invention, the aforementioned adjustment means adjusts the space by flexing the anchor along its length relative to the beam.

In still another principal aspect of the present invention, the aforementioned adjustment means flex the anchor by a greater amount adjacent its center than adjacent its ends.

In still another principal aspect of the present invention, the aforementioned adjustment means threadedly adjusts the space.

In still another principal aspect of the present invention, a method of adjusting the tension of the screen of a classifying apparatus includes the steps of attaching one end of the screen to an anchor means, attaching the other end of the screen to a rotatable tensioning means, rotating the rotatable tensioning means to exert a tension on the screen across a dimension of the screen, and adjusting the anchor means to selectively and incrementally further adjust the tension of the screen across the aforementioned dimension of the screen.

In still another principal aspect of the present invention, the anchor means is flexed in the aforementioned method to selectively and incrementally further adjust the tension of the screen.

In still another principal aspect of the present invention, the anchor means is flexed in the aforementioned methods by a greater degree adjacent the center of the screen than adjacent the edges.

In still another principal aspect of the present invention, the anchor means is threadedly flexed in the aforementioned methods.

In still another principal aspect of the present invention, an anchor assembly for the screen of a classifying apparatus includes an elongate rigid beam and anchor means for anchoring the screen. The anchor means extends in spaced substantially parallel relationship to the beam and includes mounting means for mounting one end of the screen thereto. Adjustment means extends between the beam and the anchor means for selectively flexing the anchor means to adjust the size of the space between the anchor means and the rigid beam over the length of the beam.

In still another principal aspect of the present invention, in the aformentioned assembly the beam and the anchor means are substantially coextensive in length and their ends are fixed against movement relative to each other.

In still another principal aspect of the present invention, the adjustment means in the aforementioned anchor assemblies include threaded means extending between the beam and the anchor means intermediate their ends.

These and other objects, features and advantages of the present invention will be clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
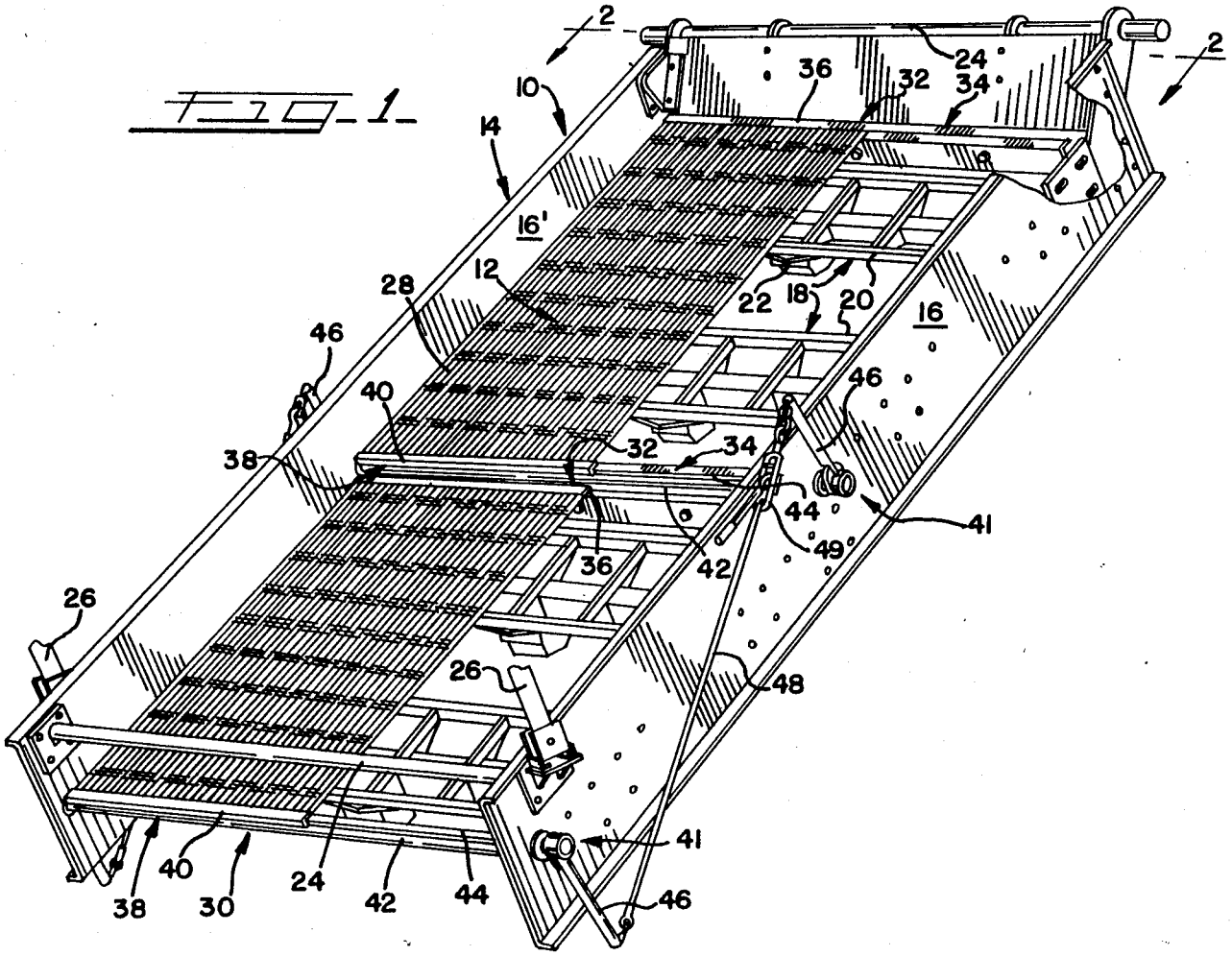
FIG. 1 is an overall perspective view of a classifying apparatus incorporating a preferred embodiment of improved tensioning assembly in accordance with the principles of the present invention, and in which the screen deck has been partially cut away to show the components of the deck that underlie the screens.

An overall perspective view of a vibratory screen classifying apparatus 10 incorporating the principles of the present invention is shown in FIG. 1. Generally, the classifying apparatus 10 comprises a vibrating screening deck 12 mounted within a rigid frame 14. The classifying apparatus as shown in FIG. 1 is similar to that shown in the aforementioned U.S. Letters Pat. No. 4,732,670 and, as such, the apparatus 10 will be described in general terms only, the specific details of the screening apparatus disclosed in the aforementioned application being incorporated herein by reference. It will be understood that apparatus other than that shown generally in the drawings may be selected by persons skilled in the art without departing from the principles of the invention.

The classifying apparatus 10 includes a pair of longitudinally extending, rigid frame sidewalls 16, 16', such as channel beams as shown in FIG. 1. The elongate sidewalls 16 are spaced apart in generally parallel relationship to each other by vibrating tappet assemblies 18 beneath the screening deck as shown in FIG. 1. The tappet assemblies 18 include spaced tappet bars 20 extending transversely between the frame sidewalls 16, 16' and vibrators 22 for vibrating the tappet assemblies 18 and the screening deck 12 which lie upon the tappet bars and are supported by them. The details of the tappet assemblies 18 and their functions are fully described in U.S. Pat. No. 4,444,656, the disclosure of which is incorporated herein by reference. It will be understood that mechanisms for vibrating the screens other than those shown in the drawings may be employed in the invention.

The frame walls 16, 16' are held in rigid spaced apart relationship by mounting tubes 24 which may provide the additional function of assisting in the suspension of the frame in angular relationship to a corresponding conveyor unit (not shown) which delivers the solid particulate matter to the top of the screening deck 12. Such suspension may be by way of suspension arms or cables 26, also as shown in FIG. 1. The suspension cables or arms 26 may be adjusted to change the angle of inclination of the vibrating screening deck 12 depending upon the particulate solids to be classified. Again, the manner of suspending the screening deck in the tappet assembly construction may take other various forms and do not form a principal part of the present invention per se.

As is conventional in classifying apparatus, a mesh screen, such as woven wire cloth, generally 28 is mounted within the frame 14 to form the screening deck 12 over which the solids to be classified are passed. It will be understood that the screening deck may be also be formed of wire loops as are well known in the art, rather than the mesh screen as shown. Although two screens are shown, the screening deck may consist of only one screen or more than two screens.

The solids will be separated and classified with fines passing through the screens as "unders" as the material moves down the screens 28. These "unders" may be collected in a pile upon the ground or in some sort of container (not shown). The larger materials which do not pass through the screens will continue to travel down the surface of the screening deck 12 and will be discharged from the end 30 of the assembly as "overs." The "overs" also may be collected as a discrete pile upon the ground or collected in a container or the like.

Each of the screens 28 is anchored at one end 32, as shown in FIG. 1, to an anchor assembly 34 which will be described in more detail later, by a flange 36 attached to and extending along the edge of the screen 28 across its width.

As shown in FIG. 1, the other end 38 of the screen 28 also includes a flange 40 by which that end of the screen is attached a rotatable tensioning assembly, generally 41. The rotatable tensioning assembly 41 includes an elongate rotatable tube 42 having a flange 44 thereon for engaging the flange 40 on the screen. The rotatable tubes 42 of each assembly 41 are mounted in the frame sidewalls 16, 16' for rotation by levers 46 and tensioning elements 48, such as a cable and ratcheted cable hoist puller 49, as shown in FIG. 1.

The assembly thus far described in general is known and is essentially as disclosed in the aforementioned U.S. Letters Pat. No. 4,732,670. The present invention is directed to an improved screen tensioning assembly that may be incorporated in such assembly or in other screening assemblies which employ rotatable tensioning mechanisms.

As previously discussed, when a tension is drawn on the screen 28 by the rotatable tensioning assembly 41 and its tube 42, in some screening assemblies depending upon screen width, wire diameter and spacing of the screen used, the degree of tension across the width dimension of the screen might vary as the result of a difference in torque or degree of twisting in the rotatable tube 42 over its length. For example, where tensioning levers 46 are positioned on each side of the frame 14 as shown in FIG. 1, the surface of the rotatable tube 42 and its anchor flange 44 will be rotated through a slightly greater distance at the edges of the screen than in the center of the screen. This will result in greater tension at the screen edges than in the screen center, and this differential in tension across the width dimension of the screen can result in fatigue of the screen and early wear, or inefficiency of separation or both. It is the purpose of the present invention to overcome these shortcomings and to provide a substantially uniform tension across the entire width dimension of the screen 28.

Figure 2:
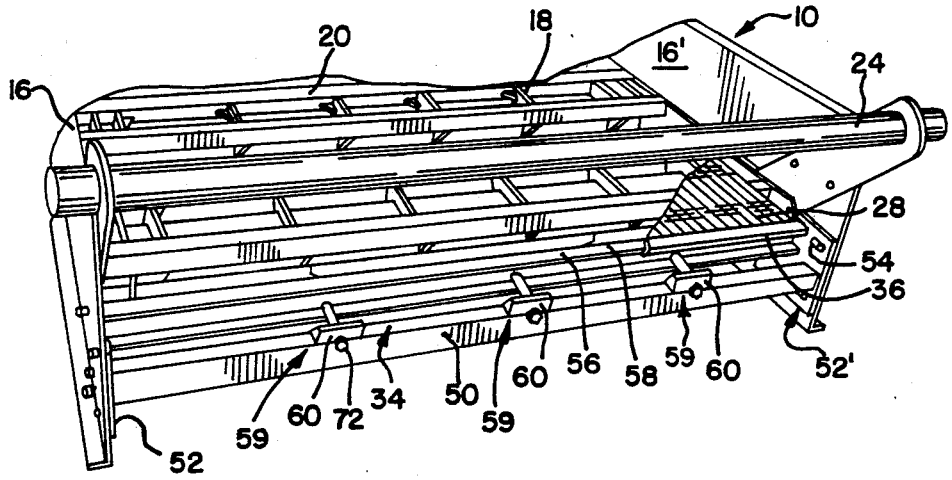
FIG. 2 is a partially cut away end view of the classifying apparatus as viewed substantially along lines 2—2 of FIG. 1.
Figure 3:
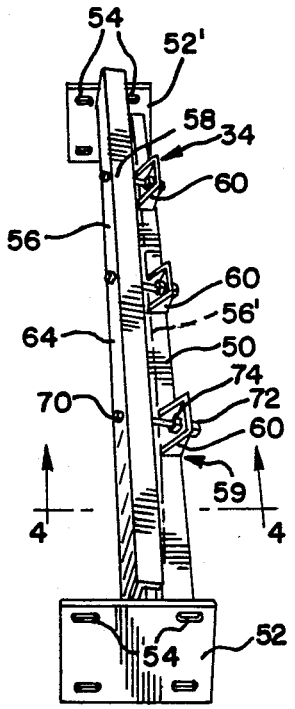
FIG. 3 is a perspective view of a preferred embodiment of screen anchor assembly incorporating the principles of the present invention.
Figure 4:
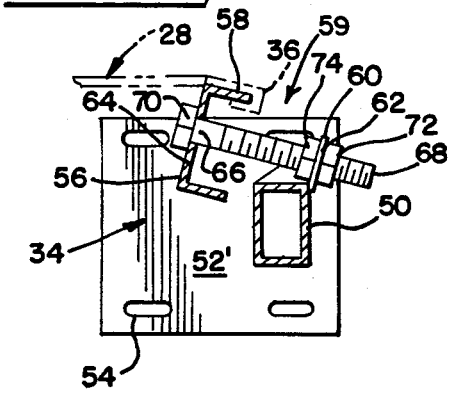
FIG. 4 is a cross sectioned end elevation view of the screen anchor assembly, as viewed substantially along line 4—4 of FIG. 3.

In the preferred embodiment of the present invention, and as best seen in FIGS. 2–4, the anchor assembly 34 opposite the rotatable tensioning assembly 41 comprises a rigid beam 50 which extends between a pair of plates 52, 52' to which the beam is fixedly attached, as by welding or the like. The plates 52, 52' preferably include a plurality of spaced slots 54 to permit the plates and anchor assembly to be bolted to the sidewalls 16, 16' of the frame 14, and permit some degree of longitudinal adjustment to compensate for variations in screen lengths.

A channel 56 is also fixedly attached at its ends by way welding or the like to the plates 52, 52'. The upper flange 58 of the channel 56 is adapted to receive the screen flange 36 to anchor the screen, as shown in FIG. 4.

Threaded adjustment means 59 include a plurality of brackets 60 fixed, for example by welding, to the top of the beam 50 at spaced intervals intermediate the length of the beam. As best seen in FIG. 4, the brackets 60 each include a hole 62, and the web 64 of the channel 56 also includes spaced holes 66 aligned with the respective bracket holes 62 to accommodate threaded bolts 68 for further adjusting the tension in the screen 28 as will be described later. The heads 70 of the bolts 68 are preferably positioned on the channel side of the assembly and the nut 72 of the bolt on the bracket side of the assembly to facilitate the adjustment of the screen tension from beneath the screen.

Adjustment of the anchor assembly 34 is accomplished incrementally and selectively over the length of the assembly by tightening selective ones of the bolts 68 on the desired spaced brackets 60. By selective tightening of these bolts, the channel assembly 56 will be flexed slightly to the position shown in dot and dash in FIG. 3. Although such flexing is slight, it is sufficient to compensate for the variation in tension across the width of the screen 28 after tensioning has initially been accomplished by the rotatable tube assembly 41.

Although it is believed that from the foregoing description, the operation of the tensioning assembly of the present invention will be clearly understood, a brief description of the tensioning of the screens 28 follows.

The screen flange 36 is first anchored to the channel flange 58 of the channel 56 of the anchor assembly 34 as shown in FIG. 4. The screen flange 40 at the other end of the screen 38 is then anchored to the flange 44 on the rotatable tube 42 of the rotatable tensioning assembly 41, as shown in FIG. 1.

Once these flanges are so engaged, the tensioning elements 48 on each side of the frame 14 are tensioned so as to remove the slack from both cables and are then further selectively tensioned on each side of the frame using, for example, the cable hoist pullers 49, to draw as uniform a tension across the width of the screen as is possible. Preferably, the tension drawn on the screen is such that the sides of the screen 28 are at the ultimate desired tension for the overall screen. In this condition, over-tensioning of the screen sides is avoided, as is early wear.

Once tensioning of the sides of the screen is complete, the center of the screen may be somewhat more slack than desired, as previously discussed. This slack may now be tensioned by way of the anchor assembly 34 so as to result in a substantially uniform and desired tension across the entire width dimension of the screen.

In order to further tension the center of the screen by way of the anchor assembly 34, the respective nuts 72 of bolts 68 are rotated so as to draw the channel 56 toward the rigid beam 50, as viewed in FIGS. 3 and 4. However, because the channel 56 is fixedly attached at each end to the plates 52, 52', the channel 56 will selectively and incrementally flex in varying degree over its length to assume the slightly bowed position 56' shown in dot and dash in FIG. 3. This incremental flexing or bowing will result in further adjustment to increase the tension on the center of the screen 28 until the tension on the screen is uniform across its width dimension. When uniformity has been achieved, the nuts 74 are tightened against the back of the brackets 60 to lock the bolt 68 in place in its adjusted position.

Where the screening deck includes more than one screen 28, the above adjustment procedure is repeated as necessary with each of the anchor assemblies 34.

It will be understood that the embodiment of the present invention which has been described is merely illustrative of one of the applications of the principles of the invention. Numerous modifications may be made by those skilled in the art without departing from the true spirit and scope of the invention.

I claim:

1. A classifying apparatus comprising a rigid frame, at least one classifying screen in the frame, anchor means for anchoring one end of the screen, and first tensioning means for tensioning the screen and including at least one elongate rotatable means adjacent the other end of the screen extending substantially across the other end of the screen, wherein the improvement in the apparatus comprises:

second tensioning means for selectively and incrementally adjusting the tension on said screen along the dimension over which the rotatable means extends, said second tensioning means including said anchor means, said anchor means comprising at least one screen anchor, said screen anchor having ends which are fixed against movement relative to said frame, said second tensioning means also including an elongate beam extending across said frame adjacent said one end of said screen, said screen anchor also extending across said frame in spaced relationship to said beam, and adjustment means for selectively and incrementally adjusting the space between said beam and said anchor along their respective lengths.

2. The classifying apparatus of claim 1, wherein said adjustment means threadedly adjusts said space.

3. The classifying apparatus of claim 1, wherein said adjustment means flexes said anchor to adjust the space between said beam and said anchor.

4. The classifying apparatus of claim 3, wherein said adjustment means threadedly adjusts said space.

5. The classifying apparatus of claim 3, wherein said adjustment means flexes said anchor by a greater amount adjacent its center than at a location spaced from its ends.

6. The classifying apparatus of claim 5, wherein said adjustment means threadedly adjusts said space.

7. A method of adjusting the tension of the screen of a classifying apparatus having a frame in which the screen is positioned, comprising the steps of:

attaching one end of the screen to an anchor means having ends which are fixed against movement relative to the frame;

attaching the other end of the screen to a rotatable tensioning means;

rotating the rotatable tensioning means to exert to tension on the screen across a dimension of the screen; and adjusting the anchor means to selectively and incrementally further adjust the tension of the screen across said dimension of the screen.

8. The method of claim 7, wherein said anchor means is flexed to selectively and incrementally further adjust the tension of the screen.

9. The method of claim 8, wherein said anchor means is threadedly flexed.

10. The method of claim 8, wherein said anchor means is flexed by a greater degree adjacent the center of the screen than adjacent its edges.

11. The method of claim 10, wherein said anchor means is threadedly flexed.

12. An anchor assembly for the screen of a classifying apparatus comprising:

an elongate rigid beam;

anchor means for anchoring the screen, said anchor means extending in spaced substantially parallel relationship to said rigid beam, said anchor means including mounting means for mounting one end of the screen thereto; said beam and said anchor means having ends which are fixed against movement relative to each other; and adjustment means extending between said beam and said anchor means for selectively flexing said anchor means to adjust the size of the space between said anchor means and said rigid beam over the length of said beam.

13. The anchor assembly of claim 12, wherein said adjustment means comprise at least one threaded means extending between said beam and said anchor means intermediate their ends.

14. The anchor means of claim 13, wherein said adjustment means comprise a plurality of said threaded means spaced from each other along the length of said beam and anchor means.

15. A classifying apparatus comprising a rigid frame, at least one classifying screen in the frame, anchor means for anchoring one end of the screen, and first tensioning means for tensioning the screen and including at least one elongate rotatable means adjacent the other end of the screen extending substantially across the other end of the screen, wherein the improvement in the apparatus comprises:

second tensioning means for selectively and incrementally adjusting the tension on said screen along the dimension over which the rotatable means extends, said second tensioning means including said anchor means, said anchor means comprising at least one screen anchor for anchoring the other end of the screen, said screen anchor having a length including ends which are fixed against movement relative to said frame, a portion of said length being movable between said fixed ends to adjust the tension on said screen.

16. The classifying apparatus of claim 15, wherein said second tensioning means comprises an elongate beam extending across said frame adjacent said one end of said screen, said screen anchor also extending across said frame in spaced relationship to said beam, and adjustment means for selectively and incrementally adjusting the space between said beam and said anchor along their respective lengths.

17. The classifying apparatus of claim 16, wherein said adjustment means threadedly adjusts said space.

18. The classifying apparatus of claim 16, wherein said adjustment means flexes said anchor to adjust the space between said beam and said anchor.

19. The classifying apparatus of claim 18, wherein said adjustment means threadedly adjusts said space.

20. The classifying apparatus of claim 18, wherein said adjustment means flexes said anchor by a greater amount at a location spaced from its ends.

21. The classifying apparatus of claim 20, wherein said adjustment means threadedly adjusts said space.

* * * * *